United States Patent [19]

Bez et al.

[11] Patent Number: 4,854,825

[45] Date of Patent: Aug. 8, 1989

[54] MULTI-STAGE VACUUM PUMP

[75] Inventors: Eckhard Bez, Moorabbin; John L. Farrant, North Balwyn, both of Australia

[73] Assignee: Commonwealth Scientific and Industrial Research Organization, Campbell, Australia

[21] Appl. No.: 19,736

[22] Filed: Feb. 27, 1987

[51] Int. Cl.[4] ..... F04B 3/00; F04B 5/00; F04B 25/02

[52] U.S. Cl. ..... 417/265; 417/266; 417/493; 417/267; 417/DIG. 1; 92/240

[58] Field of Search ..... 92/170, 240; 417/490, 417/493, 265, 503, 266, 267

[56] References Cited

U.S. PATENT DOCUMENTS

| | | | |
|---|---|---|---|
| 2,622,788 | 12/1952 | Ramilow | 417/496 |
| 2,765,976 | 10/1956 | Stewart | 417/165 |
| 2,888,879 | 6/1959 | Gaarder | 92/170 |
| 3,375,972 | 4/1968 | Raufeisen | 92/240 |
| 3,779,672 | 12/1973 | Schroeder | 417/493 |
| 3,839,946 | 10/1974 | Paget | 92/170 |
| 3,915,597 | 10/1975 | Grant | 417/490 |
| 3,961,868 | 6/1976 | Droege | 417/550 |
| 4,023,467 | 5/1977 | Thurner | 92/240 |
| 4,387,568 | 6/1983 | Dineen | 60/520 |
| 4,417,857 | 11/1983 | Sudbeck | 417/490 |
| 4,560,327 | 12/1985 | Bez | 417/493 |
| 4,572,056 | 2/1986 | Furke | 92/86 |
| 4,657,488 | 4/1987 | Weinhardt | 417/267 |

FOREIGN PATENT DOCUMENTS

| | | | |
|---|---|---|---|
| 471116 | 7/1972 | Australia | 417/503 |
| 3150119 | 6/1983 | Fed. Rep. of Germany | 417/242 |
| 48202 | 2/1982 | Japan | 417/490 |

OTHER PUBLICATIONS

A High-Performance Oil-Free Backing Pump for Electron Microscopes published in Ninth International Congress on Electron Microscopy, Toronto, 1978, vol. 1.

A High-Performance Oil-Free Backing Pump for Electron Microscopes published by Ninth International Congress on Electron Microscopy, Toronto, 1978, vol. I.

*Primary Examiner*—William L. Freeh

*Attorney, Agent, or Firm*—Sughrue, Mion, Zinn, Macpeak & Seas

[57] ABSTRACT

A vacuum pump includes two pairs of piston and cylinder assemblies mounted on opposite sides of a crankshaft in a common plane with the gas inlets for the first and second cylinders of a first pair of piston and cylinder assemblies being connected to the device to be evacuated and the gas outlets thereof being connected to a common outlet having a spring biased one-way valve controlling the outlet and to a passage connected to the inlet of a third cylinder in said second pair of piston and cylinder assemblies. The gas outlet of the third cylinder is connected to the inlet of the fourth cylinder and the gas outlet of the fourth cylinder is connected to the common outlet through spring biased one-way valves. Each cylinder is provided with a cylinder head having a pair of one-way valves controlling inlet and outlet ports wherein the one-way valve controlling the gas inlet port acts as a torque reduction valve to reduce the amount of torque necessary to move the piston away from the cylinder head on the initial stroke of the piston. Each cylinder is provided with a liner in the form of a sleeve having an hard wear resistant oxide coating thereon and each piston is provided with a coating of filled polytetrafluorethylene for the purpose of reducing friction.

6 Claims, 3 Drawing Sheets

MULTI-STAGE VACUUM PUMP

BACKGROUND OF THE INVENTION

The present invention is directed to a multistage vacuum pump and more specifically to a unique valve arrangement providing for a reduction of starting torque, a high pressure idling arrangement for one of the stages during startup and a cylinder liner providing an improved air intake arrangement and high wear resistance.

Australian Patents Nos. 481072 and 516210 and International Patent Application No. PCT/AU82/00128, which are all assigned to the same assignee as the present application, disclose various forms of a reciprocatory piston and cylinder machine having a differential piston and two working spaces. In the practical application of such a machine it is usual to provide multiple cylinders as respective stages of a multistage pump. The machine is particularly well suited for use as a mechanical vacuum pump utilizing solid sealing rings or sleeves in lieu of oil or other liquid lubricant. A four cylinder pump having a pair of parallel coupled high vacuum cylinders, jointly connected in series with a medium vacuum cylinder and a low vacuum cylinder is particularly appropriate and has the advantage of being suitable for construction in well balanced configurations. In prior pumps the connections between these stages have been made by covered passages and external conduits, but these are not readily translated into an internal porting and ducting arrangement, especially because of the presence of two working spaces per working cylinder.

The U.S. Pat. No. 4,560,327, to Bez et al., discloses a porting and ducting arrangement for a pair of adjacent cylinders of a multistage vacuum pump wherein a plurality of passages extend longitudinally in the walls of the cylinders and communicate with the interiors of the cylinders through respective ports. A plurality of recesses in the form of arcuate depressions may be located in the ends of the cylinder walls or in the bottom surface of the cylinder head which register with respective passages or groups of passages and suitable openings are provided in the cylinder head in communication with the recesses for supplying or exhausting fluid to or from the interiors of the cylinders. This patent is also assigned to the assignee of the present application.

Copending U.S. patent application Ser. No. 820,585, now U.S. Pat. No. 4,790,726, filed Jan. 21, 1986, which is a continuation of application Ser. No. 491,967, now abandoned filed Apr. 13, 1983, in the name of Balkau et al., and assigned to the same assignee as the present application, is also directed to a reciprocatory piston and cylinder machine adapted to be used as an oil free vacuum pump. The vacuum pump disclosed in this application is directed to a cylinder having a first portion closed at one end and a second portion contiguous with, but of smaller diameter than, the first portion, and a piston having a cylindrical head portion slidable in the first cylinder portion and a second cylindrical piston portion slidable in the second cylinder portion with said piston head portion having a front face facing the closed cylinder end and an annular back face. A gas inlet is provided for introducing gas to the interior of the first cylinder portion between the front face of the piston head portion and the closed cylinder end on reciprocation of the piston. A first exhaust port is provided for exhausting gas from the interior of the first cylinder portion ahead of the piston head portion by the pumping action of the front face of the piston head portion, a one way valve is provided in the first exhaust port which is operable to permit the exhaust of gas from the interior of the first cylinder portion ahead of the piston head portion and a second exhaust port is provided for the exhaust of gas from the interior of the first cylinder portion behind the piston head portion by the pumping action of the back face of the piston head portion. Sealing means are provided for the piston head portion which includes a sleeve of a low friction material disposed on the cylindrical surface of the piston such that over the temperature range encountered during the normal operation of the pump a mean gap is sustained between the sleeve and the cylinder, which gap is of a maximum size at which leakage of gas past the sleeve is at a level for an acceptable degree of vacuum to be sustained by the pump. A similar sleeve is provided on the second piston portion and resilient means are provided adjacent the end of the sleeve remote from the first piston portion for forcing the sleeve into sliding engagement with the wall of the cylinder. Furthermore the one way valve in the exhaust port is provided with projecting means which are adapted to be engaged by the piston for opening the valve in the exhaust port controlled thereby on each stroke of the piston even though the pressure within the cylinder is too low to open the valve against the force of the spring biasing the valve into normally closed position.

SUMMARY OF THE INVENTION

The present invention is directed to a new and improved oil free, multi-stage vacuum pump having the cylinders, crankcase and passage means formed in a single casting with two pairs of cylinders opposed to each other in a substantially common plane on opposite sides of the axis of crankshaft support means extending perpendicular to the axes of the cylinders. Each cylinder is provided with a larger diameter portion adjacent the cylinder head and a smaller diameter portion adjacent the axis of the crankshaft and a sleeve having a complementary configuration is inserted in each cylinder and provided with a wear resistant coating such as anodised aluminum, aluminum oxide, electroless nickel or other suitable material on the internal surface thereof. A step piston is reciprocally mounted in each sleeve and is operatively connected to a crankshaft mounted for rotation in the crankcase. Each cylinder head is provided with a pair of oppositely acting spring biased one way valves. One of the valves acts as a torque reduction valve by allowing the gas to enter into the cylinder in front of the piston during one or more strokes of the piston away from the cylinder head and so oppose the force exerted on the annular back face of the piston by the gas in the space behind the piston and the other one way valve acts as an exhaust valve during the compression stroke of the piston.

One pair of piston and cylinder assemblies are considered the high pressure pumping assemblies while the other pair of piston and cylinder assemblies are considered to the be the low pressure pumping assemblies. The device to be pumped out is connected to an inlet located intermediate a first pair of cylinders and a gas is applied to each cylinder through the torque reduction valves located in the cylinder heads as well as through substantially annular passages located in the sidewall of the larger diameter portion of each cylinder sleeve. During the initial stage of operation while the pressure is still high in the device to be pumped down the flow of exhaust gas from the cylinders of the low pressure pumping assemblies moves along an exhaust passage through an exhaust valve to an outlet leading to the atmosphere while a relatively small amount of exhaust gas moves along a crossover passage to the cylinder of the first piston and cylinder assembly of the other pair of piston and cylinder assemblies which constitute the high pressure pumping assemblies. The inlet and outlet valves for the cylinders of the high pressure pumping assemblies are not directly connected to the crossover passage but communicate with each other externally of the cylinders so that during the initial operation of the second pair of piston and cylinder assemblies the first piston and cylinder assembly in the second pair will effectively idle. Once the pressure of the gas delivered from the low pressure pumping assemblies is sufficiently low so that the inlet valves will not be opened by gas pressure in the high pressure pumping assemblies, the gas will enter the cylinders of the second pair of piston and cylinder assemblies through inlet ports in the side walls of each cylinder controlled by the motion of the piston. The second pair of piston and cylinder assemblies, which constitute the high pressure assemblies, will then be able to further reduce the pressure in the device.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
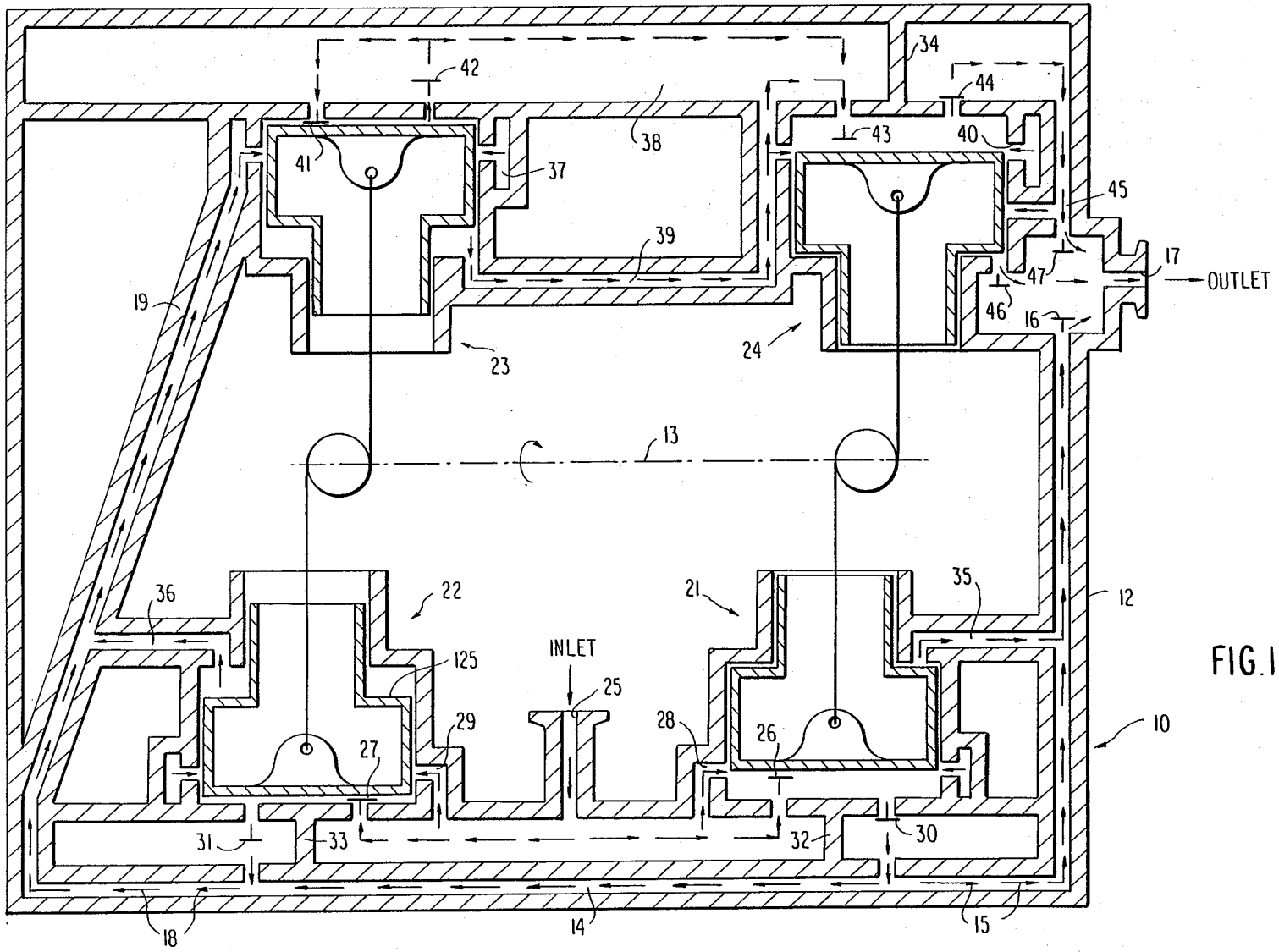
FIG. 1 is a schematic plan view of the multi-stage vacuum pump including the flow passages interconnecting the piston and cylinder assemblies thereof.

In describing the oil free vacuum pump according to the present invention the pressure differential within the vacuum pump from the inlet to the outlet will be such that the lowest pressure will exist adjacent the inlet and the highest pressure approximating atmospheric pressure will exist adjacent the outlet of the pump.

The oil free vacuum pump according to the present invention has a compression ratio exceeding 50,000:1 and is capable of pumping a vessel down from atmospheric pressure to a very high vacuum of the order of hundredths of a millimeter of mercury or even better vacuum. The vacuum pump is provided with a one piece crankcase and cylinder casting having interconnecting passages between the different piston and cylinder assemblies integrally formed in the casting. The vacuum pump is a multi-stage pump having four piston and cylinder assemblies arranged as shown in the schematic diagram of FIG. 1.

The pump 10 is provided with a unitary cast housing 12 having four piston and cylinder assemblies 21, 22, 23, and 24, disposed therein. The axes of the four piston and cylinder assemblies are disposed in a common plane with the axes of the piston and cylinder assemblies 21 and 22 being opposed to but slightly offset from the axes of the piston and cylinder assemblies 23 and 24. Each piston and cylinder assembly is provided with a stepped configuration with the pistons being substantially identical in construction to the piston disclosed in copending application Ser. No. 820,585, referred to above. The cylinder of each assembly is provided with an insert sleeve which will be described in detail hereinafter. The piston assemblies 21 and 22 are the low pressure pumping cylinders while the piston and cylinder assemblies 23 and 24 are considered to be the high pressure pumping assemblies.

The device to be pumped down, which is not shown in FIG. 1, is adapted to be connected to the inlet 25 disposed intermediate the piston and cylinder assemblies 21 and 22 and the gas from the device is supplied to each piston and cylinder assembly through torque reduction valves 26 and 27 which act as inlet valves located in the cylinder heads as well as through substantially annular inlet passages 28 and 29 located in the side wall of the larger diameter portion of each cylinder. As the piston in each piston and cylinder assembly 21 and 22 reciprocates the gas is forced outwardly through exhaust valves 30 and 31 into a common passage 14.

During the initial stages of operation while the pressure is still high in the device to be pumped down the flow of exhaust gas from the piston and cylinder assemblies 21 and 22 moves along the passage 14 in the direction of the arrows 15 through an exhaust valve 16 to an outlet 17 while a relatively small amount of gas moves along the passage 14 in the direction of the arrows 18 through the crossover passage 19 to the high pressure piston and cylinder assemblies 23 and 24. The gas exhausted from the piston and cylinder assemblies 21 and 22 through the exhaust ports 35 and 36 also flows in the same manner as the gas from the exhaust ports 30 and 31.

The piston and cylinder assembly 23 is provided with an exhaust valve 42 and a torque reduction valve 41 which acts as an inlet valve. The piston and cylinder assembly 24 is provided with an exhaust valve 44 and torque reduction valve 43 in the cylinder head which acts as an inlet valve. Partitions 32, 33, and 34, formed in transverse passages within the housing and are located between the torque reduction valves and the exhaust valves in the cylinder heads of piston and cylinder assemblies 21, 22, and 24, respectively. There is no such partition associated with the cylinder head of piston and cylinder assembly 23 so that during the initial portion of the pumping cycle much of the gas being pumped out through the exhaust valve 42 flows right back into the cylinder through the torque reduction valve 41 so that the piston in the piston and cylinder assembly 23 operates in a substantially idle mode. During the initial high pressure stages of the pumping operation the proportion of gas being pumped through the annular inlet passage 37 of the piston and cylinder assembly 23 is small. The pressure in the passages 14 and 19 will eventually fall to a level which will no longer be sufficient to open the exhaust valve 16 and therefore all of the gas pumped out of the piston and cylinder assemblies 21 and 22 will pass through the passageway 19 to the inlet passage 37 for the piston and cylinder assembly 23. The exhaust gas from the piston and cylinder assembly 23 flows through the passages 38 and 39 into the piston and cylinder assembly 24 through the torque reduction valve 43 and the annular inlet passage 40. Under these conditions the piston and cylinder assemblies 23 and 24 will also become effective to reduce the pressure in the device connected to the inlet 25. The piston and cylinder assembly 24 is the only one of the four assemblies wherein the gas exhausted through the exhaust valve 44 in the cylinder head is supplied through a substantially annular inlet passage 45 to the opposite end of the piston. This gives an extra stage of pumping since the portions of the cylinder on opposite ends of the piston are connected in series. They finally exhaust through the valve 46 into the outlet 17.

Figure 3:
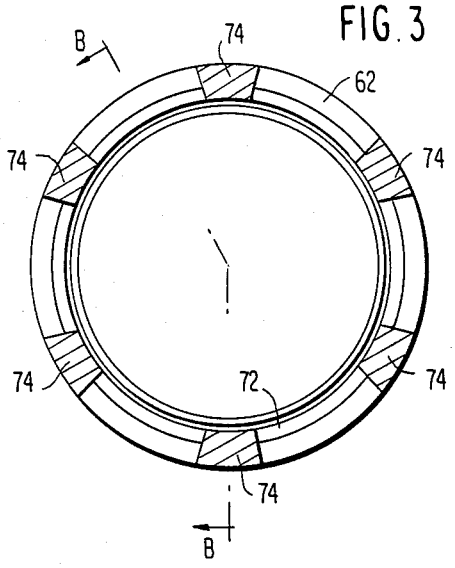
FIG. 3 is a sectional view taken along the line A-A in FIG. 2.
Figure 2:
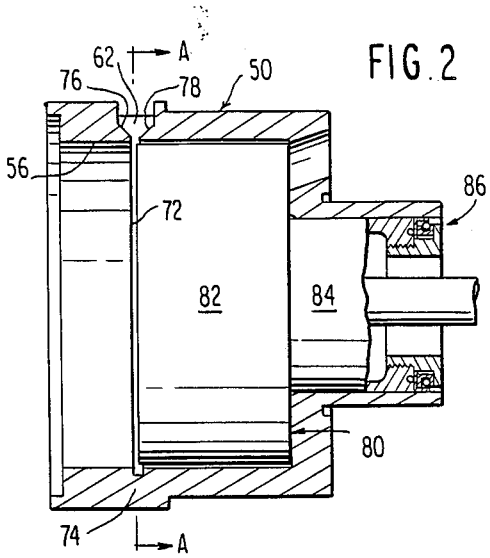
FIG. 2 is a sectional view of the sleeve insert for a cylinder taken along the line B-B in FIG. 3 with the piston operatively associated therewith being shown partially in section.
Figure 5:
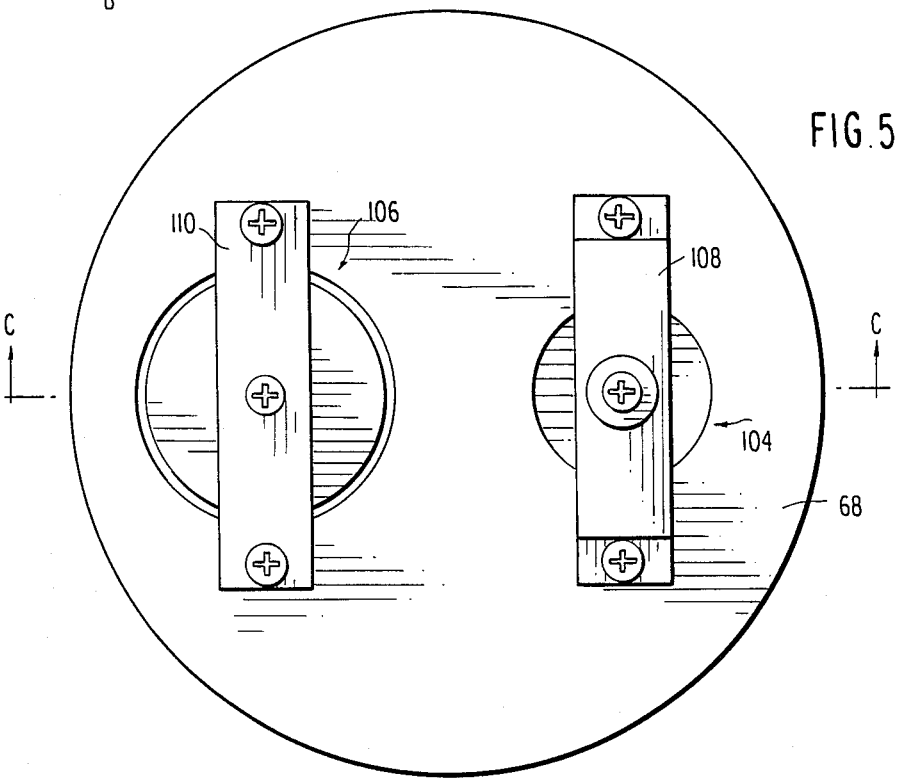
FIG. 5 is a top plan view of a cylinder head showing the inlet and outlet valves associated therewith.
Figure 4:
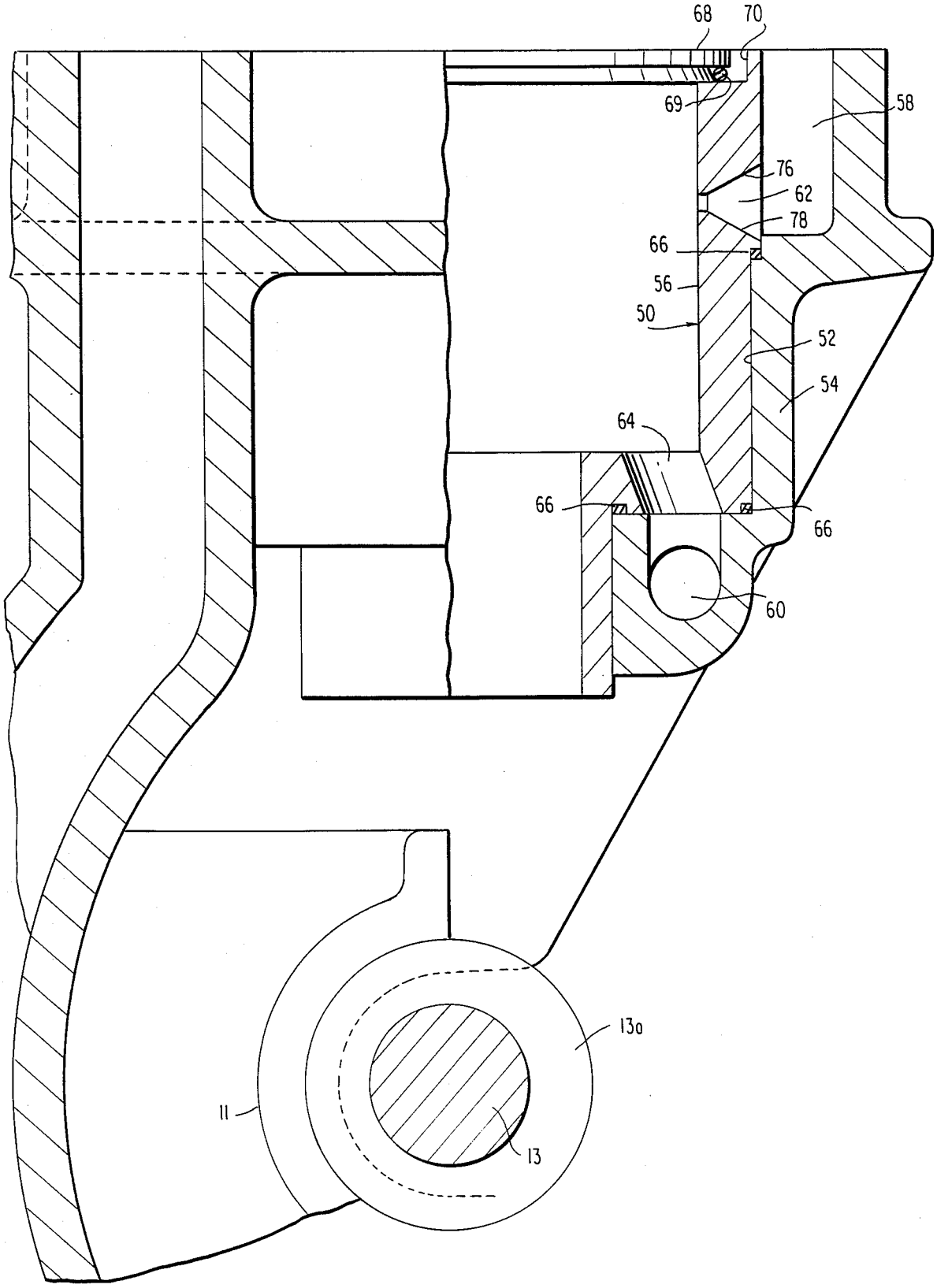
FIG. 4 is a sectional view of a portion of the vacuum pump according to the present invention showing a portion of the sleeve of FIG. 2 disposed in a cylinder and a cylinder head in engagement with the sleeve.

A cylinder liner or sleeve 50, suitable for use with each of the piston and cylinder assemblies, is disclosed in FIGS. 2, 3, and 4. The sleeve 50 has a stepped configuration similar to the piston and cylinder and is adapted to fit within the cylinder 52 of the casting 54, as best seen in FIG. 5. By using the sleeve 50 it is possible to utilize the same or a different material as used for the cylinder casting 54. Furthermore it is easier to provide the details with respect to the inlet and outlet ports by a separate sleeve than it is to provide such details on the main cylinder casting. The inner surface 56 of the sleeve 50 is provided with a wear resistant coating Such a coating on the interior surface of the sleeve 50 taken in combination with a sleeve of filled polytetrafluorethylene which is applied to the piston of the assembly, in the same manner as disclosed in copending application Ser. No. 820,585, discussed above, will provide good anti-friction and anti-wear characteristics. Once again the use of a sleeve facilitates the application of the aluminum oxide coating as opposed to applying the coating directly to the surface of the cylinder casting. The cylinder casting is provided with a substantially annular gas inlet passage 58 which cooperates with a substantially annular gas inlet passage 62 in the sleeve 50. The cylinder casting is also provided with a gas outlet passage 60 which cooperates with an air outlet passage 64 in the sleeve 50. Suitable sealing means 66 are provided between the sleeve 50 and the casting 54 to prevent the leakage of gas. The cylinder head 68 is shown in FIG. 5 disposed in an annular recess 70 formed in the upper end of the sleeve 50. The cylinder head and the valves therein will be described hereinafter with respect to FIGS. 6 and 7.

The gas inlet passage 62 in the sleeve 50 is shown in greater detail in FIGS. 2 and 3. The gas inlet passage 62 includes a slot 72 which extends three hundred sixty degrees around the interior wall 56 of the cylinder sleeve 50 and arcuate openings which extend through the wall of the sleeve substantially around the entire circumference thereof with the exception of equally spaced support posts 74 which are shown in FIG. 3. It is known that the flow of gas through a narrow slot or gap is substantially restricted, particularly at low pressure, and in order to provide for the free flow of gas into the interior of the cylinder sleeve 50 from a substantially annular plenum chamber 58 surrounding the wall of the cylinder sleeve, the sides 76 and 78 of the openings which communicate with the slot 72 diverge outwardly as shown in FIGS. 2 and 5.

The axial extent of slot 72 should be as small as possible to maximize the compression ratio but sufficient to provide good pumping speed, particularly at low pressure, the area of the slot is maximized by having the slot extend 360° about the inner surface of the sleeve 50.

As pointed out previously the stepped piston 80, as shown in FIG. 2, is provided with sleeves 82 and 84 of filled polytetrafluorethylene on the outer surfaces of the larger and smaller diameter portions of the piston, respectively, similar to the manner in which the sleeves of polytetrafluorethylene are mounted on the piston in copending application Ser. No. 820,585, as discussed above. A mean gap is provided between the sleeves and the interior surface of the cylinder liner in the manner in which the sleeves are spaced from the cylinder wall in copending application Ser. No. 820,585, and an end seal 86 is mounted on the end of the piston as shown in FIG. 2 for sealing engagement with the interior surface of the sleeve 50 adjacent the ambient atmosphere which exists within the crankcase of the pump.

Figure 6:
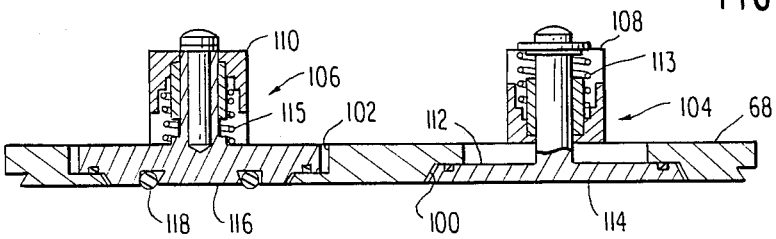
FIG. 6 is a sectional view taken along the lines C—C in FIG. 5.

The cylinder head 68, as shown in FIGS. 4–6, inclusive, is suitable for use as a cylinder head on each of the piston and cylinder assemblies disclosed in FIG. 1. The cylinder head 68 may be secured in sealing relation with respect to the cylinder sleeve 50 by any suitable means with an O-ring 69 interposed therebetween. The cylinder head is provided with an gas inlet port 100 and an gas outlet port 102. Each of the ports is provided with a spring biased one way valve assembly 104 and 106, respectively. The valve assemblies 104 and 106 are mounted on the cylinder heads 68 by means of straps 108 and 110, which are secured to the cylinder head by screws or the like. The gas inlet valve assembly 104 opens to allow gas to enter the cylinder through the inlet port 100 when the pressure of the gas on the upper surface 112 of the valve member 114 is sufficient to overcome the force of the spring 113 and the force exerted by any gas pressure to the lower surface of the valve and move the valve member 114 downwardly as shown in FIG. 6. The provision of such an inlet valve in the cylinder head substantially reduces the torque necessary to move the piston downwardly on the initial intake strokes. Without such an inlet valve the gas would not be admitted to the cylinder until the piston almost reaches the bottom dead center portion of its stroke and uncovers the slot 72 in the side wall of the sleeve 50 and the downward movement of the piston in the cylinder would create a reduced pressure in the upper end of the cylinder so that the driving force for the piston would have to both overcome the force the atmospheric air pressure exerts on the piston and also the force exerted by gas pressure on the annular surface 125 of the piston. By using such a valve the amount of torque necessary to move the piston downwardly on the initial intake strokes and when substantial amounts of gas are being pumped can be substantially reduced so that the size of the motor for the vacuum pump can be significantly lower in horsepower than would be required in the absence of inlet valves 104. Eventually the pressure on the upper surface 112 of the valve member 114 will be insufficient to overcome the force of the spring and the valve member 114 will remain closed and gas will enter the cylinder solely through the annular slot 72.

The valve assembly 106 for controlling the outlet port 102 is designed to open upon the compression stroke of the piston with the gas compressed by the piston overcoming the force of the spring 115 to move the valve member 116 upwardly as viewed in FIG. 6 to open the outlet port 102. As the pumping operation continues the pressure of the gas compressed by the piston and cylinder assemblies 21, 22, 23 and 24, will be reduced to the point where the pressure will be insufficient to overcome the spring force of the spring biased valve assemblies 106. Thus to move the valve member 116 to the open condition a resilient O-ring 118 is mounted in a circular groove in the bottom surface of the valve member 116. The O-ring 118 protrudes below the lower surface of the cylinder head 68 and projects into the cylinder chamber such that the O-ring 118 will be contacted by the piston as it moves to its upper dead center point to move the valve member 116 upwardly as viewed in FIG. 6 to open the gas outlet passage 102. The O-ring 118 could be mounted on the piston instead of the valve member. Likewise, any other suitable projection could be used instead of the O-ring. This type of valve assembly for the gas outlet port is disclosed in copending application Ser. No. 820,585, discussed above.

The multi-stage vacuum pump as described above is capable of evacuating a gas filled container to an extremely low pressure producing an oil free environment. The provision of a unitary casting for the crankcase and cylinder assemblies as well as a number of the passages provides a vacuum pump which is compact and efficient inasmuch as there is less chance of leakage. The sectional view shown in FIG. 4 illustrates a portion of the casting which includes one of the cylinder assemblies and the integral support 11 for the crankshaft 13 and bearing assembly 13*a*. The first and second piston and cylinder assemblies 21 and 22 are substantially identical and operate to quickly reduce the pressure in the device which is being evacuated and thus constitute a first stage of the vacuum pump. Once the pressure in the passage 14 is reduced to a level at which the valve 16 remains closed the second stage constituted by the piston and cylinder assembly 23 will effectively evacuate the gas on both sides of the large diameter portion of the piston in each of the first and second assemblies 21 and 22. The crossover passage 19 communicates with the cylinder of the assembly 23 but does not communicate with the passage 38 so that the piston and cylinder assembly 23 will effectively idle at higher pressures. The piston and cylinder assembly 24 effectively evacuates the chambers on opposite sides of the piston of the piston and cylinder assembly 23 and the chambers on opposite sides of the piston of the piston and cylinder assembly 24 are effectively evacuated through the valves 46, 47. A single outlet is provided for the entire system as to reduce the possibility of leakage to the atmosphere, especially when the pump is used for evacuating noxious gases or collecting expensive or noble gases.

The crankcase and cylinder casting may be an aluminum alloy or any other suitable material. Likewise the cylinder sleeve may be an aluminum alloy or any other suitable material upon which a coating consisting of anodised aluminum, aluminum oxide, electroless nickel or other suitable wear resistant particles may be placed.

While the invention has been particularly shown and described with reference to preferred embodiments thereof it will be understood by those in the art that the foregoing and other changes in form and details may be made therein without departing from the spirit and scope of the invention.

What is claimed is:

1. A multi-stage recipricatory vacuum pump, comprising:

first, second, third and fourth cylinders each having a first portion closed at one end and a second portion contiguous with, but of smaller diameter than the first portion;

each cylinder being provided with a piston having a cylindrical head portion relatively slideable in the first cylinder portion and a second cylindrical piston portion relatively slideable in the second cylinder portion, said piston head portion having a front face facing the closed cylinder end to define a main pumping chamber and an annular backface to define an annular pumping chamber;

a gas inlet port disposed in each first cylinder portion and adapted to be uncovered when said piston reaches a bottom dead center position of each piston stroke;

common drive means for reciprocating each piston in a respective cylinder;

a first exhaust port in each first cylinder portion for exhaustion of gas from the main pumping chamber by pumping action of the front face of the piston head portion;

a one way valve in said first exhaust port operable to permit exhaustion of gas from the main pumping chamber ahead of the piston head portion;

a second exhaust port in each cylinder for exhaustion of gas from the annular pumping chamber by pumping action of the annular backface of the piston head portion;

common inlet passage means connected to the gas inlet ports of said first and second cylinders;

first and second exhaust passages connected to the first and second exhaust ports of said first and second cylinders respectively;

a common passage interconnecting said first and second exhaust passages and communicating with a first outlet valve and a third exhaust passages connecting the first exhaust port of the third cylinder with the inlet port of the fourth cylinder;

a fourth exhaust passage connecting the second exhaust port of the third cylinder with the third exhaust passage; and a final exhaust passage connecting the first exhaust valve of the fourth cylinder to a second outlet valve.

2. A multi stage vacuum pump according to claim 1 further comprising a final inlet port connected between said final exhaust passage and the annular pumping chamber of the fourth cylinder at a location to be uncovered when the piston in the fourth cylinder approaches the top of its stroke, a third outlet valve associated with the second outlet port of the fourth cylinder and common outlet passage means connected to said first, second and third outlet valves.

3. A multi-stage vacuum pump according to claim 1 wherein said means for reciprocating pistons are arranged so that the first and fourth pistons reach the top of their stroke when the second and third pistons reach the bottom of their stroke.

4. A multi-stage vacuum pump according to claim 1 wherein each cylinder includes second valve means comprising a one way valve having biasing means adapted to only allow gas into each main pumping chamber whereby upon initial movement of said piston away from said head said second valve means will open, thereby limiting the amount of torque necessary to reciprocate the pistons when starting.

5. A multi-stage vacuum pump according to claim 1 wherein each piston and cylinder is provided with contacting sliding surfaces one of which is a wear resistant hard surface and the other of which is low friction surface.

6. A multi-step vacuum pump according to claim 5 wherein the sliding surface of each piston is comprised of polytetrafluoroethylene filled with materials for limiting wear-rate and the sliding surface of each cylinder is comprised of a wear resistant coating of aluminum oxide and each piston and cylinder are dimensioned to define a mean gap therebetween which will be maintained over the entire range of temperature to which each piston and cylinder will be subjected during normal operation of the pump.

* * * * *